United States Patent [19]

Ishimoto

[11] 4,112,615

[45] Sep. 12, 1978

[54] REMOTE CONTROL SYSTEM FOR A MOVABLE TOY VEHICLE

[75] Inventor: Zenichi Ishimoto, Tokyo, Japan

[73] Assignee: Nikko Co., Ltd., Tokyo, Japan

[21] Appl. No.: 727,622

[22] Filed: Sep. 28, 1976

[51] Int. Cl.[2] ..... A63H 29/18; A63H 30/00

[52] U.S. Cl. ..... 46/254

[58] Field of Search ..... 46/253–259; 343/225

[56] References Cited

U.S. PATENT DOCUMENTS 3,878,521 4/1975 Licitis ..... 343/225

FOREIGN PATENT DOCUMENTS 994,832 6/1965 United Kingdom ..... 46/254

*Primary Examiner*—Louis G. Mancene
*Assistant Examiner*—Robert F. Cutting

[57] ABSTRACT

A wireless trans-ceiver control system for a motor driven toy vehicle having a transmitter for generating a predetermined carrier of selected high frequency, and a receiving unit including a super regenerative detection circuit for receiving the high frequency carrier and normally producing an amplifiable noise signal which is attenuated by the high frequency carrier. A relay switch, for reversing the power to the electrical motor driving the toy vehicle, is energized by the amplified noise signal to retain the switch in one position and release the relay to a second position when the high frequency carrier from the transmitter attenuates said noise signal. In a modification, a gearing train drives the vehicle in one direction in one position of the switch but drives the vehicle in the same direction and also turns the wheels for turning the vehicle in the second position of the switch.

3 Claims, 9 Drawing Figures

REMOTE CONTROL SYSTEM FOR A MOVABLE TOY VEHICLE

BACKGROUND OF THE INVENTION

This invention is concerned with a remote control transceiving system for a travelling toy vehicle in which a carrier of single transmitting channel is used to selectively achieve two different operations, such as (1) straight forward or reverse movement, (2) straight forward or turning forward movement, (3) straight reverse or turning reverse movement and (4) starting or stopping.

In the remote control toy vehicle heretofore used, the carrier of two channels have been employed to obtain two different operations of the toy vehicle. Otherwise, the applied frequency is modulated for receipt by the receiving unit to obtain two different operations of the toy vehicle. The circuit designed to increase the channel or modulate the frequency for amplification however needs a complicated structure making it more costly and more likely to malfunction due to its increased complexity.

A principal object of the present invention is to provide a wireless control system particularly for a travelling toy which permits at least two functional operations of the toy to be obtained with the simple structure.

These objects as well as others will be observed from the following disclosure.

SUMMARY OF THE INVENTION

In the system according to the present invention there is provided a remote transmitter which includes a generator for a carrier signal of specific frequency and a receiving unit in the toy vehicle. The receiving unit includes a super regenerative detection circuit for receiving the signal from the transmitter unit and for normally generating a noise signal which is attenutated by the transmitted signal. An amplifier for the received signal and/or the noise signal, and a relay operated two position switch, is also provided. The relay is energized by the amplified noise signal to move its switch contact from a first, relay de-energized position, to a second position. A battery driven motor is thus reversed by the relay operated switch to selectively propel the toy vehicle in a forward or reverse direction. By selectively energizing the transmitter the noise level of the receiver is reduced thus controlling the operation of the relay.

In another embodiment a gearing train is interposed between the motor and drive wheels to drive the vehicle in one direction when the motor is driven forwardly and to drive the vehicle in the same direction and simultaneously turn the front wheels when the motor is driven in the reverse direction.

Full details of the present invention are set forth in the detailed description which follows and are shown in the accompanying drawings.

DESCRIPTION OF THE INVENTION

Figure 1:
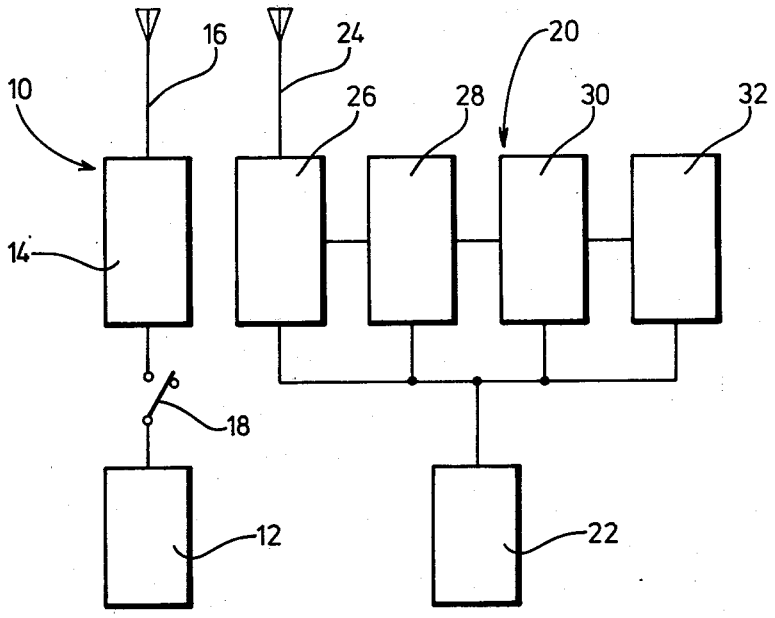
FIG. 1 is a block diagram of the remote control system of the present invention.

In FIG. 1, the reference numeral 10 represents a remote transmitter unit which includes a power source 12 such as a battery, a circuit 14 for generating a high frequency carrier (such as of approximately 27 $MH_z$), an antenna 16 and a switch 18 for interrupting flow of the current from the power source 12 to the high frequency carrier generating circuit 14.

The receiving unit 20 mounted on the toy vehicle includes a second power source 22, and a receiving antenna 24, a super regenerative detection circuit 26 capable of generating an amplifiable noise signal when not receiving and for receiving the high frequency carrier (27 $MH_z$) which attenuates the noise signal. A transistorized amplifier 28 is provided for amplifying the received and/or the noise signal the output of which controls a relay 30 having switches operative in a first position by the noise signal amplified by the amplifier 28 and operative in a second position as by the spring bias, when receiving the carrier frequency (27 $MH_z$) which attenuates the noise signal to control the motor 32. Motor 32 operates either forward or in reverse in accordance with the position of switches of the relay 30.

Figure 3:
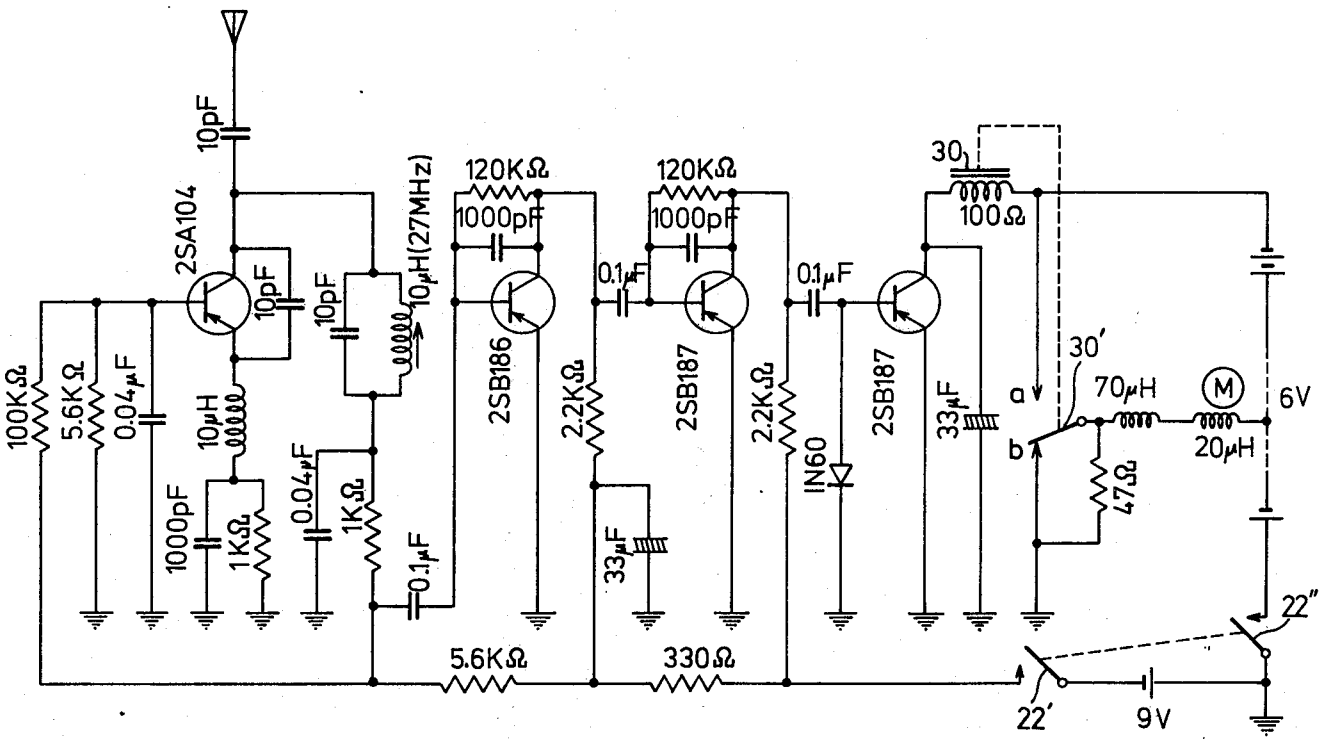
FIG. 3 is a detailed circuit diagram of the receiving unit shown in FIG. 1.

As seen in FIG. 3, the relay 30 is operated by the passage of current through the last transistor 2SB187 in the amplifier 28 so that when the last transistor (2SB 187) of the receiver is conductive there is caused conductivity in the coil of the relay 30 so that the switch contact 31 is moved into engagement with the position *a*. In other words, the relay contact 31 comprises a spring piece which normally contacts with the contact *b* under the spring function so that when the transistor is non-conductive, the relay coil is also non-conductive and the relay is left in contact with the contact *b*. The receiver produces noise even when the transmitter remains OFF. This noise is amplified by the amplification circuit 28 so that a predetermined bias voltage will be applied to the base terminal of the last stage transistor (2SB 187) to render the transistor ON. As a result of which current is supplied to a collector of the transistor to render the coil of relay 30 conductive. Accordingly, the noise is of the type which is amplified by the amplification circuit to obtain a base terminal voltage sufficient to achieve the ON operation of the last stage transistor. When the signal of specific frequency is generated by the transmitter and such signal is received by the tuning circuit 26 of the receiver, the noise signal generated by the receiver per se is considerably reduced, as a result of which the relay 30 can be de-energized. By using the relay circuit in combination with the receiver, as shown in FIG. 3, the ON-OFF operation of the motor for driving the running toy can achieved by a convenient wireless control in several modes.

Figure 2:
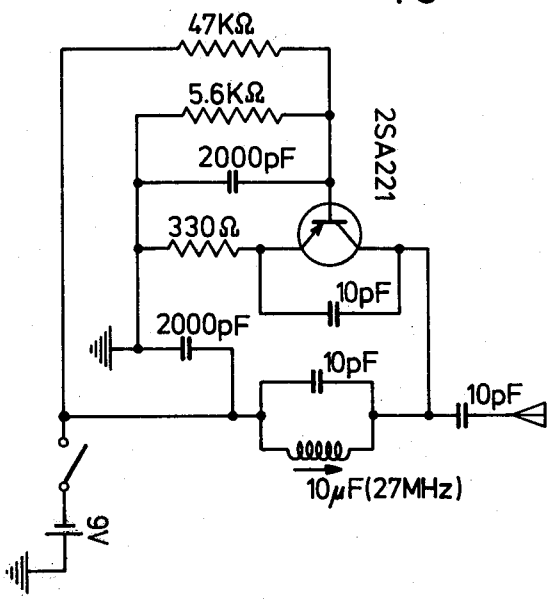
FIG. 2 is a detailed circuit diagram of the transmitter system shown in FIG. 1.

As seen in FIG. 2, the transmitter 14 comprises an oscillator adapted to generate a carrier signal of specific frequency only on the closing of the switch 18 which controls the power from the source, which may preferably be a battery. This carrier signal is received shown in FIG. 3 in the receiver and employed to operate the relay 30 which governs the operation of the motor 32. The relay 30 is furthermore operated, even when the transmitter is closed, by the noise developed in the receiver per se. In other words, the carrier signal of specific frequency, when transmitted by the transmitter 14, is received by the receiver to restrain the quenching noise with decrease of the output and when the operation of the transmitter is stopped, the quenching noise output of the receiver is increased. Therefore, in accordance with the displacement of the quenching noise output, a desired switching operation of a single relay contact may be achieved (see FIG. 3).

The toy vehicle in accordance with the present invention may include the various types of operations as classified below.

| Type of toy | OPERATIONS | |
|---|---|---|
| Operation | I | II |
| Type A | forward (straight) | rearward (straight) |
| Type B | forward (straight) | stopping |
| Type C | forward (straight) | forward (turning) |

Figure 4:
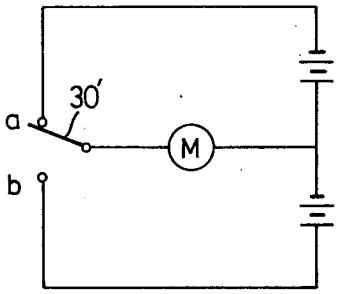
FIG. 4 is a detailed view of a portion of FIG. 3 showing the circuit arrangement for one mode of motor operation.

The operation of the receiver to achieve the function Type A is achieved through two cooperative switches 22' and 22" which connects the receiver 26, amplifier 28 and motor 32 to the battery 22. Upon placing the switches 22' and 22" in ON position the receiver detection system 26, produces sufficient noise through transistor 2SB 187 which biases the relay 30 so that contact 31 is moved into position *a* and motor M is driven forwardly. This occurs even when transmitter 14 is not operating. When, however, the transmitter is placed in operation the high frequency signal emitted by it is received, detected and amplified, and fed to transistor 2SB 187 so as to overcome the noise produced signal. This results in the de-energization of the relay 30 causing the relay contact 31 to come into contact with the contact *b* resulting in a reversal of the current from the battery 22 driving the motor M reversely (in this case the toy vehicle moves rearwardly). When the operation of the transmitter is again discontinued, the noise produced in the receiver is amplified energizing the relay 30 so that the relay 31 again comes into contact with the contact *a* to drive the motor M normally (in this case the toy vehicle again moves forwardly). In order to stop the movement of the toy vehicle, the two cooperative switches 22' and 22" of the battery 22 are manually opened to cut off the receiver and the motor from the power source. Discontinuance of the operation of the receiver stops the movement of the toy vehicle. FIG. 4 is a simplified schematic diagram of the circuit formed between contact 31, motor 32 and the battery for driving the motor of the toy vehicle when both switches 22' and 22" are closed. From this circuit diagram, it will be appreciated that when the receiver is operated, in cooperation of the transmitter 14 switching of contact 31 is easily effected and the toy vehicle may be moved rearwardly or forwardly. The transmitter may be easily operated simply by the ON-OFF operation of the switch 18 between battery 12 and the transmitter.

Figure 5:
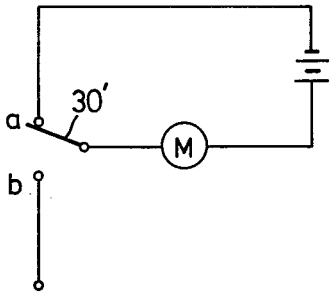
FIG. 5 is a detailed view of a portion of FIG. 3 showing the circuit arrangement for another mode of motor operation.
Figure 6:
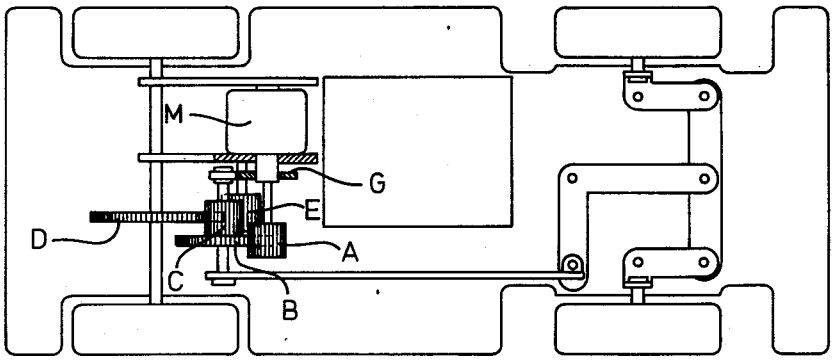
FIG. 6 is a plan view of a toy showing a transmission control system to which the present invention may be applied.
Figure 7:
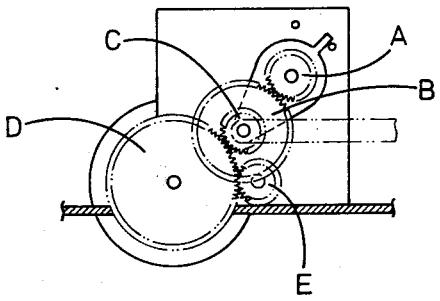
FIG. 7 is an end view showing the gearing of the toy of FIG. 6 in one mode of operation.
Figure 8:
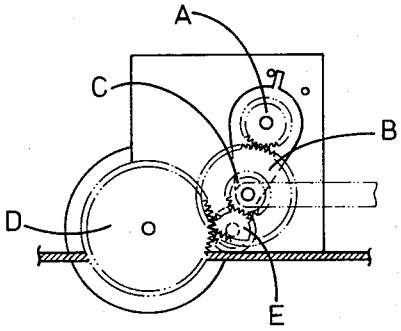
FIG. 8 is another view showing the gearing of the toy in another mode.
Figure 9:
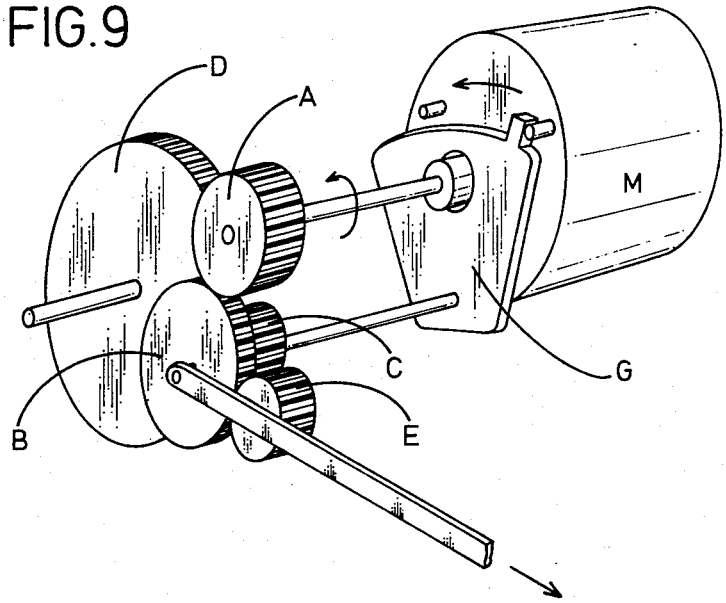
FIG. 9 is an enlarged perspective view of the gearing of FIG. 6.

To obtain the vehicle function Type B, the driving circuit of the motor 32 is arranged as illustrated in FIG. 5. Namely, by leaving open the switch 22" the position *b* with which the contact 31 of the relay 30 engages is maintained opened and is not grounded so that when the relay 30 is de-energized the contact 31 although engaging the position *b* breaks the current connection between the motor 32 and the power source 22 thus arresting the driving operation bringing the vehicle to a stop.

To obtain the vehicle function Type C, the driving circuit of the motor 32 is arranged as illustrated in FIG. 4 and is also provided with a transmission mechanism arranged between the motor and the driving wheels of the vehicle as illustrated in FIGS. 6 - 9. In this construction the toy vehicle has its rear wheels, mounted on a common axle 4 driving by a transmission or gear chain comprising a driving gear A connected to the shaft 5 of the motor M and a pair of gears B and C mounted on a common shaft 6, which is secured at one end to a pivotal section member G and at the opposite end to a steering rod 7. The gear member C meshes with a gear D fixed on shaft 4 while gear B meshes with the gear A fixed on the end of the motor drive shaft 5. A gear E spaced from the gear C is axially supported on another shaft 8 so as to also mesh with the gear D. The shaft 8 is fixed to the motor or frame of the vehicle and freely journals the gear E in mesh with the gear D. The steering rod 7 is connected at its forward end to a bell crank and lever system 9 connected to the front wheels. When the turning direction of the driving shaft of the motor M is in the direction indicated by arrow $R_1$ the action of the gears A and B causes gear C to engage the drive gear D rotating the wheels in corresponding direction but when the rotation of the motor M is converted in the direction of the arrow $R_2$ the turning force of the gear A on the gear B causes the gears B and C with its common shaft to move away from the gear D toward the direction of the arrow O. Gears B and C swing until brought to a stop at the position where the gear C engages with the gear E causing the gear E to rotate. Because of the inposition of gear E in the train between B, C and D the gear D is caused to rotate in same relative direction as $R_1$ thus maintain the vehicle moving in the same direction. Simultaneously, upon movement of the gears B and C, the rod member 6 is moved to the direction of the arrow O to change the direction of the front wheels while turning the member G counterclockwise around the fixed position of the driving shaft of the motor M.

As obvious from the above explanation, the invention of the present application embodies the toy vehicles having the functional Types A, B and C with possibilities of further modified embodiments which are the combinations of A, B and C. Further when the two functional operations are required to run the toy vehicle, the stopping of the toy vehicle may be performed by manually operating the switch connected to the battery 22.

As hereinbefore fully described the present invention, enables two or more operations of the remote control toy to be attained through the single radio channel without however modulating the high frequency carrier and with only simple mechanical structure.

Further in accordance with the system of the present invention, multiple operations may be effected sequentially under the specific program by alternate receipt of the specified high frequency carrier signal and the other noise signal.

As will now be appreciated, the objective of providing a low cost simple to operate remove control toy is fulfilled by the invention in requiring but a single channel receiver and transmitter the carrier of which, when modulated at predetermined frequencies, permits straight and turning movement of the toy vehicle and also enables stopping and reverse movement of the vehicle by the simple expedient of operating an ON-OFF switch in the transmitting unit.

What is claimed is:

1. A remote control system for a travelling toy vehicle comprising a transmitter unit including a high frequency generating means for a carrier signal of specific predetermined frequency, and a receiving unit including a super regenerative detection circuit for receiving said signal and for normally generating an amplifiable noise signal, said receiving unit serving to attenuate said noise signal when receiving said carrier signal, a relay having a two-position switch normally retained in a first position when energized by the amplified noise signal and movable to a second position when the noise signal is attenuated by the transmission of the carrier signal, a motor for driving said vehicle and a battery-operated control circuit including the switch of said relay to selectively operate the motor in opposite directions.

2. The system defined in claim 1, in which said control circuit selectively drives the vehicle forwardly or in reverse.

3. The system defined in claim 1, in which said vehicle includes gearing means operated by said control circuit and connected simultaneously to the drive wheels and steering wheels whereby the vehicle is driven straight and in a desired direction when the motor rotates forwardly and is driven in the same direction when the steering wheels are turned the motor is reversed.

* * * * *